US005524761A

United States Patent [19]

Wayman

[11] Patent Number: 5,524,761

[45] Date of Patent: Jun. 11, 1996

[54] PICNIC COOLER

[76] Inventor: Shawn C. Wayman, 10 Hill Top Dr., Loudon, N.H. 03301

[21] Appl. No.: 368,978

[22] Filed: Jan. 5, 1995

[51] Int. Cl.[6] ..... A45C 11/20

[52] U.S. Cl. ..... 206/545; 206/541; 206/549; 220/521

[58] Field of Search ..... 206/545, 541, 206/549; 62/457.1, 457.3, 371, 372, 459, 464, 465, 60; 220/521

[56] References Cited

U.S. PATENT DOCUMENTS

| | | | |
|---|---|---|---|
| D. 309,239 | 7/1990 | Deines et al. | D7/605 |
| D. 325,324 | 4/1992 | Kahl | D7/605 |
| 3,347,354 | 10/1967 | Loest | 206/541 |
| 3,432,025 | 3/1969 | Lohe | 206/545 |
| 3,979,007 | 9/1976 | Thornbloom, Jr. | 220/522 |
| 4,424,687 | 1/1984 | Morgan | 62/457 |
| 4,662,188 | 5/1987 | Hullihan | 62/372 |
| 4,974,426 | 12/1990 | Gomez et al. | 62/464 X |
| 5,052,184 | 10/1991 | Jarvis | 62/60 |
| 5,052,185 | 10/1991 | Spahr | 62/60 |

*Primary Examiner*—Paul T. Sewell
*Assistant Examiner*—Tara L. Laster

[57] ABSTRACT

A new and improved picnic cooler comprised of an insulated container having an interior surface and an exterior surface. The exterior surface of a front wall has two securement clasps theresecured. The interior surface of the front wall and of the interior surface of a back wall have a plurality of securement shelves secure thereto. Contained in the device is a lid having a front edge and a back edge. The back edge is hingedly secured to an upper portion of the back wall of the insulated container. The lid covers the insulated container in a closed configuration. The front edge of the lid is engaged by the two securement clasps of the insulated container when in the closed configuration. The lid has a carrying handle secured thereto. A plurality of adjustable racks are removably secured to the plurality of securement shelves of the insulated container.

1 Claim, 4 Drawing Sheets

PICNIC COOLER

BACKGROUND OF THE INVENTION

1. Field of the Invention

The present invention relates to a picnic cooler and more particularly pertains to enabling picnic food to remain cold for an extended period of time with a picnic cooler.

2. Description of the Prior Art

The use of portable coolers is known in the prior art. More specifically, portable coolers heretofore devised and utilized for the purpose of storing food items are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 325,324 to Kahl discloses the ornamental design for a portable ice chest.

U.S. Pat. No. 5,052,185 to Spahr discloses an ice chest rack system.

U.S. Pat. No. Des. 309,239 to Deines et al. discloses the ornamental design for a picnic cooler.

U.S. Pat. No. 4,662,188 to Hullihan discloses a portable cooler or ice chest.

U.S. Pat. No. 3,979,007 to Thornbloom, Jr. discloses a picnic cooler.

While these devices fulfill their respective, particular objective and requirements, the aforementioned patents do not describe a picnic cooler for enabling picnic food to remain cold for an extended period of time.

In this respect, the picnic cooler according to the present invention substantially departs from the conventional concepts and designs of the prior art, and in doing so provides an apparatus primarily developed for the purpose of enabling picnic food to remain cold for an extended period of time.

Therefore, it can be appreciated that there exists a continuing need for new and improved picnic cooler which can be used for enabling picnic food to remain cold for an extended period of time. In this regard, the present invention substantially fulfills this need.

SUMMARY OF THE INVENTION

In the view of the foregoing disadvantages inherent in the known types of portable coolers now present in the prior art, the present invention provides an improved picnic cooler. As such, the general purpose of the present invention, which will be described subsequently in greater detail, is to provide a new and improved picnic cooler and method which has all the advantages of the prior art and none of the disadvantages.

To attain this, the present invention essentially comprises an insulated container having an open top, a closed bottom, a front wall, a back wall, two side walls, an interior surface, and an exterior surface. The exterior surface of the front wall has a circular recess formed therein. The exterior surface of the back wall has a circular recess formed therein. The exterior surface of the front wall has two securement clasps theresecured. One of the two side walls has a drainage aperture with a removable stopper therein upwardly of the closed bottom. Each of the two side walls has a pivoting handle secured to the exterior surface thereof downwardly of the open top. The interior surface of the front wall and of the back wall have a plurality of securement shelves secure thereto. The device contains a lid having a front edge and a back edge. The back edge is hingedly secured to an upper portion of the back wall of the insulated container. The lid has circular recesses corresponding with the circular recess formed in the front wall and the circular recess formed in the back wall. The lid covers the open top of the insulated container in a closed configuration. The front edge of the lid is engaged by the two securement clasps of the insulated container when in the closed configuration. The lid has a carrying handle secured thereto. The device contains a plurality of adjustable racks. Each of the racks has two sections. The two sections have a hinged rod therebetween. The two sections each has a securement rod secured to an end portion thereof opposing the hinged rod. Each hinged rod and each securement rod of the two sections is removably secured to the plurality of securement shelves of the insulated container. The device contains two insulated thermos'. Each of the two thermos' has a dispensing spout in a lower portion thereof. Each of the two thermos' has a handle extending outwardly thereof. The two thermos' are removably coupled with the circular recess in the front wall of the insulated container and the circular recess in the back wall of the insulated container with the handle flush with the respective front wall and back wall of the insulated container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved picnic cooler which has all the advantages of the prior art portable coolers and none of the disadvantages.

It is another object of the present invention to provide a new and improved picnic cooler which may be easily and efficiently manufactured and marketed.

It is a further object of the present invention to provide a new and improved picnic cooler which is of durable and reliable construction.

An even further object of the present invention is to provide a new and improved picnic cooler which is susceptible of a low cost of manufacture with regard to both materials and labor, and which accordingly is then susceptible of low prices of sale to the consuming public, thereby making such a picnic cooler economically available to the buying public.

Still yet another object of the present invention is provide a new and improved picnic cooler which provides in the apparatuses and methods of the prior art some of the advantages thereof, while simultaneously overcoming some of the disadvantages normally associated therewith.

Even still another object of the present invention is to provide a new and improved picnic cooler for enabling picnic food to remain cold for an extended period of time.

Lastly, it is an object of the present invention to provide a new and improved picnic cooler comprised of an insulated container having an interior surface and an exterior surface. The exterior surface of a front wall has two securement clasps theresecured. The interior surface of the front wall and of the interior surface of a back wall have a plurality of securement shelves secure thereto. Contained in the device is a lid having a front edge and a back edge. The back edge is hingedly secured to an upper portion of the back wall of the insulated container. The lid covers the insulated container in a closed configuration. The front edge of the lid is engaged by the two securement clasps of the insulated container when in the closed configuration. The lid has a carrying handle secured thereto. A plurality of adjustable racks are removably secured to the plurality of securement shelves of the insulated container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
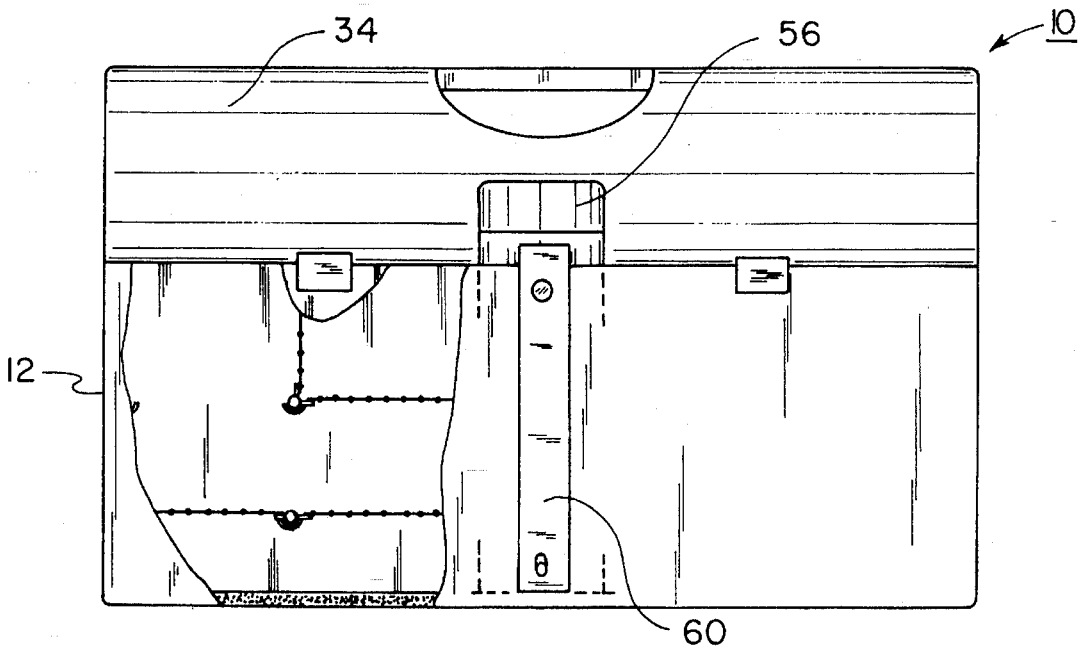
FIG. 1 is a front elevation view of the present invention partially exposing the interior thereof.
Figure 2:
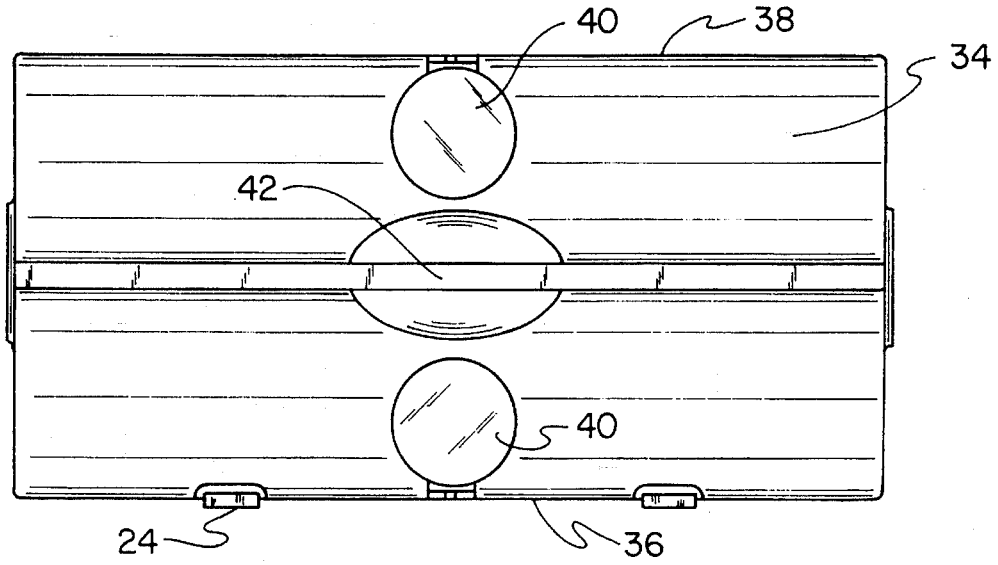
FIG. 2 is a plan view of the preferred embodiment of the present invention.
Figure 3:
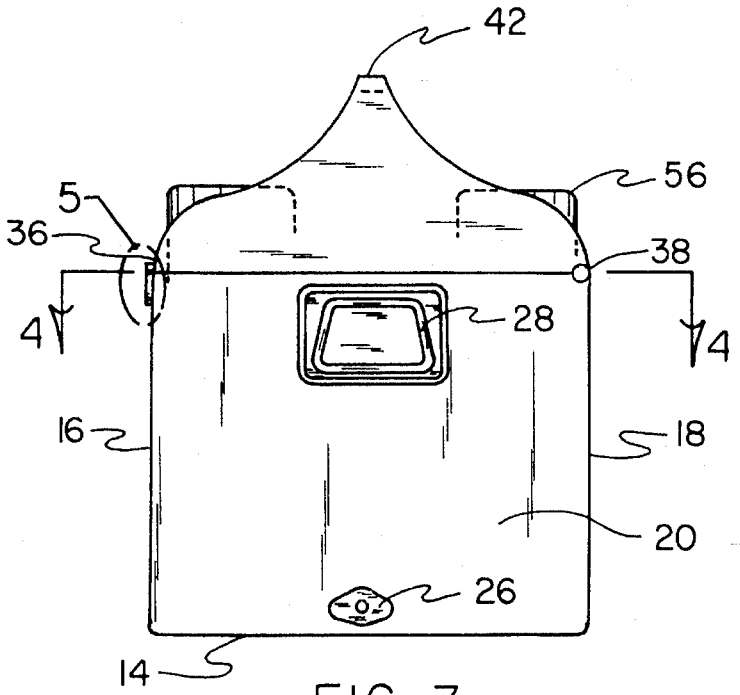
FIG. 3 is a side elevation view of the present invention.
Figure 4:
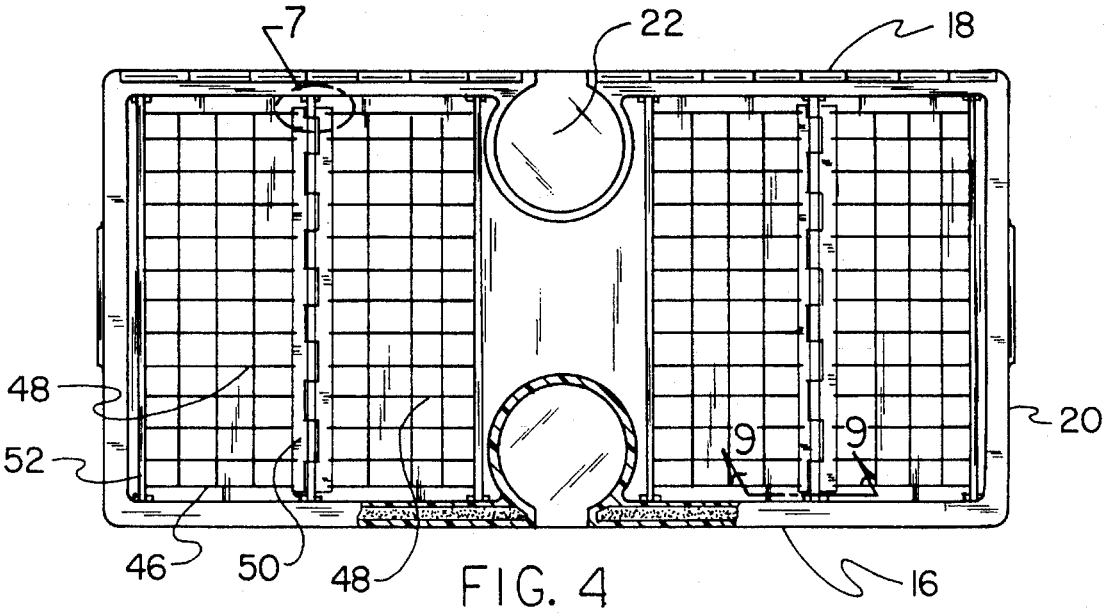
FIG. 4 is a cross-sectional view as taken along line 4—4 of FIG. 3.
Figure 5:
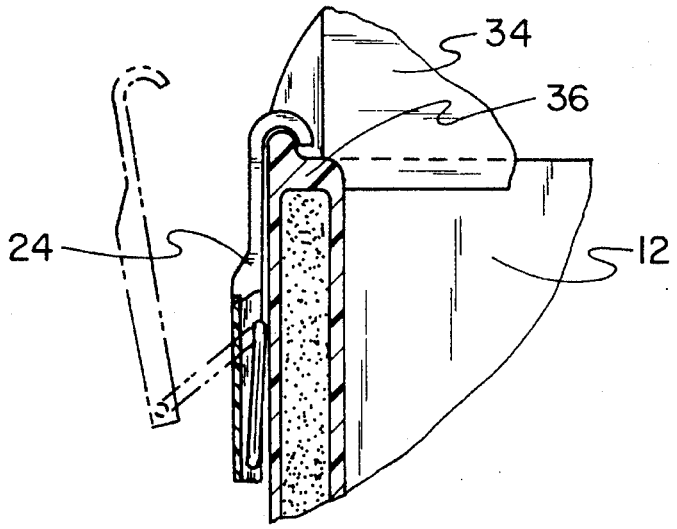
FIG. 5 is an enlarged view of the front latch closure of the present invention.
Figure 6:
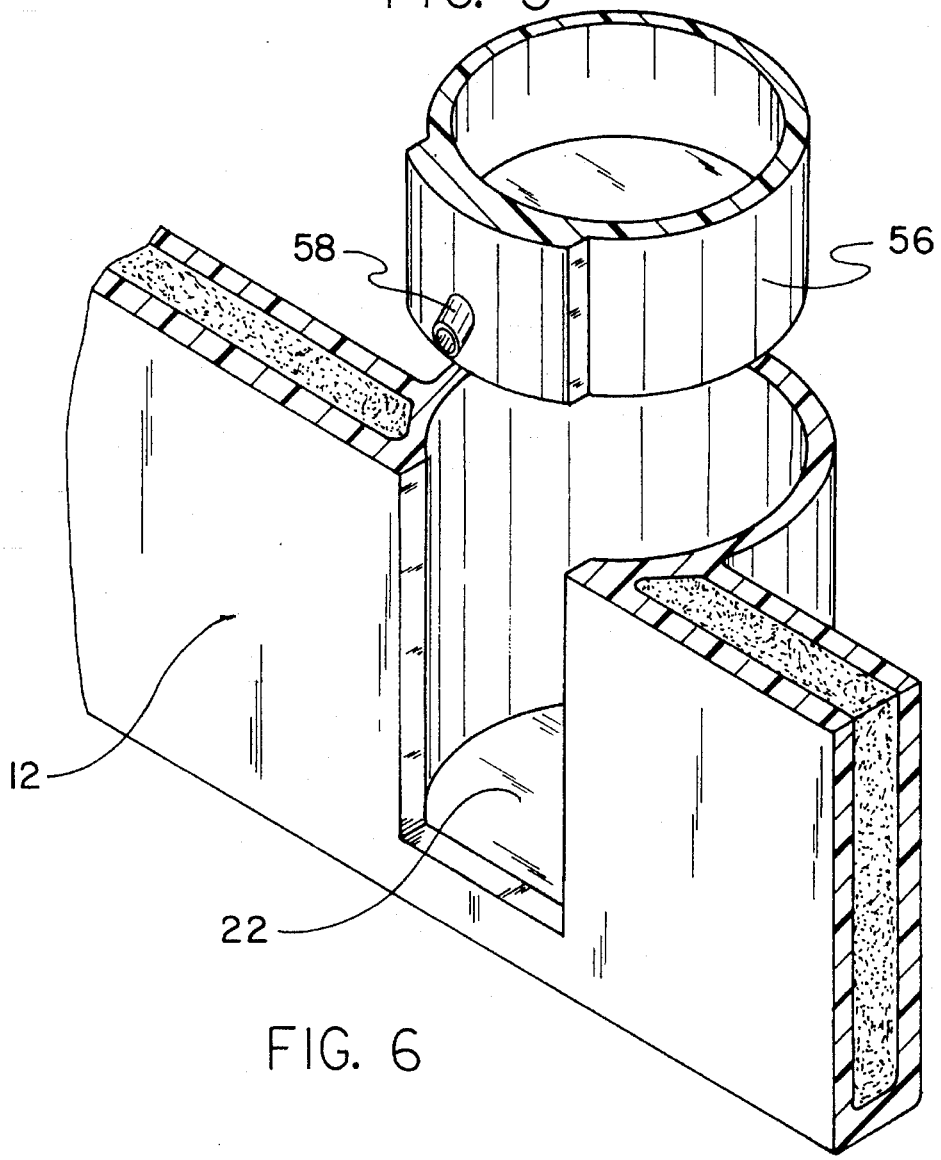
FIG. 6 is a partial perspective view of the removable thermal bottles of the present invention.
Figure 7:
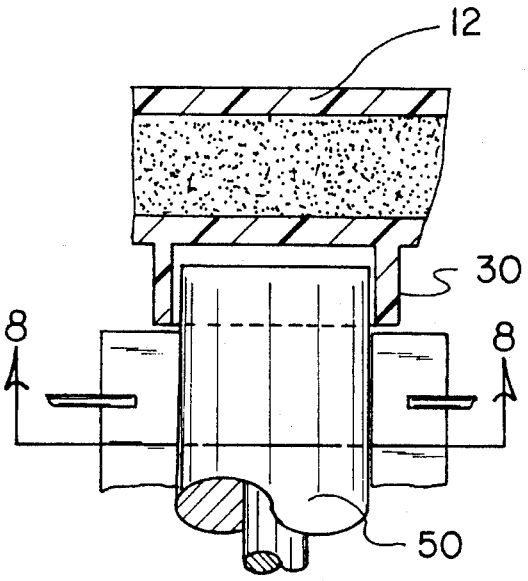
FIG. 7 is an enlarged view of the hinged rack of the present invention.
Figure 8:
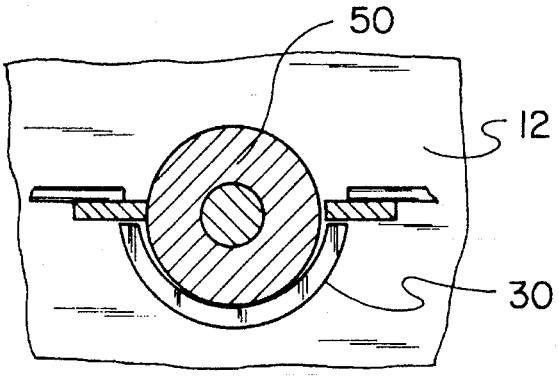
FIG. 8 is a cross-sectional view as taken along line 8—8 of FIG. 7.
Figure 9:
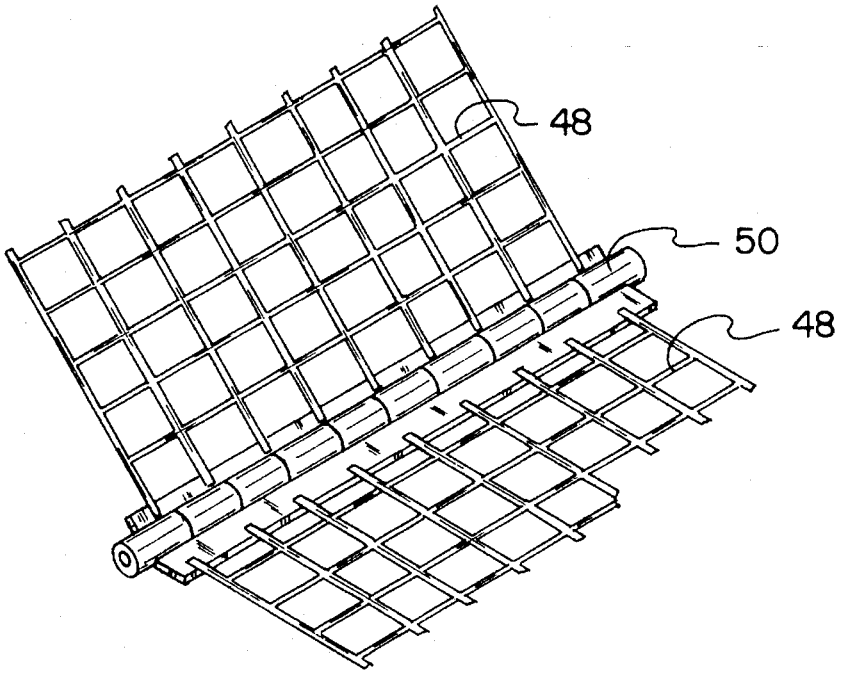
FIG. 9 is a perspective view of the hinged rack of the present invention.

With reference now to the drawings, and in particular, to FIG. 1 thereof, the preferred embodiment of the new and improved picnic cooler embodying the principles and concepts of the present invention and generally designated by the reference number 10 will be described.

Specifically, it will be noted in the various Figures that the device relates to a new and improved picnic cooler for enabling picnic food to remain cold for an extended period of time. In its broadest context, the device consists of an insulated container, a lid, a plurality of adjustable racks, and two thermal bottles.

The device 10 contains an insulated container 12 having an open top, a closed bottom 14, a front wall 16, a back wall 18, two side walls 20, an interior surface, and an exterior surface. The exterior surface of the front wall 16 has a circular recess 22 formed therein. The exterior surface of the back wall 18 has a circular recess 22 formed therein. The exterior surface of the front wall 16 has two securement clasps 24 theresecured. One of the two side walls 20 has a drainage aperture with a removable stopper 26 therein upwardly of the closed bottom 14. Each of the two side walls 20 has a pivoting handle 28 secured to the exterior surface thereof downwardly of the open top. The interior surface of the front wall 16 and of the back wall 18 have a plurality of securement shelves 30 secure thereto.

The device 10 contains a lid 34 having a front edge 36 and a back edge 38. The back edge 38 is hingedly secured to an upper portion of the back wall 18 of the insulated container 12. The lid 34 has circular recesses 40 corresponding with the circular recess 22 formed in the front wall 16 and the circular recess 22 formed in the back wall 18. The lid 34 covers the open top of the insulated container 12 in a closed configuration. The front edge 36 of the lid 34 is engaged by the two securement clasps 24 of the insulated container 12 when in the closed configuration. The lid 12 has a carrying handle 42 secured thereto.

The device 10 contains a plurality of adjustable storage racks 46. Each of the racks 46 has two sections 48. The two sections 48 have a hinged rod 50 therebetween. The two sections 48 each has a securement rod 52 secured to an end portion thereof opposing the hinged rod 50. Each hinged rod 50 and each securement rod 52 of the two sections 48 is removably secured to the plurality of securement shelves 30 of the insulated container 12. The plurality of adjustable racks 46 are positionable so as to allow ice to be stored in the closed bottom 14 of the insulated container 12 with the racks 46 preventing any food items from coming in contact with the ice.

The device 10 contains two thermal bottles 56. Each of the two thermal bottles 56 has a dispensing spout 58 in a lower portion thereof. Each of the two thermal bottles 56 has a handle 60 extending outwardly thereof. The two thermal bottles 56 are removably coupled with the circular recess 22 in the front wall 16 of the insulated container 12 and the circular recess 22 in the back wall 18 of the insulated container 12 with the handle 60 flush with the respective front wall 16 and back wall 18 of the insulated container 12. Liquids can be poured out of the dispensing spout 58 while within the circular recess 22 or the thermal bottles 56 can be removed if necessary.

The present invention is a picnic cooler containing two removable insulated thermal bottles 56, storage racks 46, and a uniquely designed cooling chamber.

This dual compartment cooler is approximately 30" long, 14" wide, and 14" high. The interior of the unit contains hinged and folding racks 46 which enable the food to be separately stacked and stored. Two built-in, yet removable thermal bottles 56 are featured along the side which include outer spouts, for accessibility from the outside. A cooling chamber is included along the entire bottom of the cooler in which ice is stored away from the contents. This heavy duty plastic unit includes two side handles as well as a top carrying bar. A front latch closure secures the top lid in place while two hinge pins enable the cover to be lifted and placed in an open, upright position.

Ice or frozen cold packs are placed within the bottom cooling chamber. Selected beverages are then poured into the two 64 oz. thermal bottles and properly secured on the cooler. Sandwiches, fruits, and other desired picnic items are placed within the cooler, spaced approximately on the hinged racks. Should the racks not be necessary, they are easily folded within the cooler or removed.

This uniquely designed cooler enables picnic food to remain cold for an extended period of time, and prevents the contents from becoming crushed or damaged by the other items within the cooler.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved picnic cooler for enabling picnic food to remain cold for an extended period of time comprising, in combination:

an insulated container having an open top, a closed bottom, a front wall, a back wall, two side walls, an interior surface, and an exterior surface, the exterior surface of the front wall having a circular recess formed therein, the exterior surface of the back wall having a circular recess formed therein, the exterior surface of the front wall having two securement clasps theresecured, one of the two side walls having a drainage aperture with removable stopper therein upwardly of the closed bottom, each of the two side walls having a pivoting handle secured to the exterior surface thereof downwardly of the open top, the interior surface of the front wall and of the back wall having a plurality of securement shelves secure thereto;

a lid having a front edge and a back edge, the back edge hingedly secured to an upper portion of the back wall of the insulated container, the lid having circular recesses corresponding with the circular recess formed in the front wall and the circular recess formed in the back wall, the lid covering the open top of the insulated container in a closed configuration, the front edge of the lid engaged by the two securement clasps of the insulated container when in the closed configuration, the lid having a carrying handle secured thereto;

a plurality of folding racks, each of the racks having two sections, the two sections having a hinged rod therebetween, the two sections each having a securement rod secured to an end portion thereof opposing the hinged rod, each hinged rod and each securement rod of the two sections removably secured to the plurality of securement shelves of the insulated container;

two insulated thermal bottles, each of the two thermal bottles having a dispensing spout in a lower portion thereof, each of the two thermal bottles having a handle extending outwardly thereof, the two thermal bottles removably coupled with the circular recess in the front wall of the insulated container and the circular recess in the back wall of the insulated container with the handle flush with the respective front wall and back wall of the insulated container.

* * * * *